US009431758B2

(12) United States Patent
Kurita

(10) Patent No.: US 9,431,758 B2
(45) Date of Patent: Aug. 30, 2016

(54) CONNECTOR WITH GROMMET

(71) Applicant: Sumitomo Wiring Systems, Ltd., Yokkaichi, Mie (JP)

(72) Inventor: Atsushi Kurita, Mie (JP)

(73) Assignee: SUMITOMO WIRING SYSTEMS, LTD (JP)

( * ) Notice: Subject to any disclaimer, the term of this patent is extended or adjusted under 35 U.S.C. 154(b) by 0 days.

(21) Appl. No.: 14/686,808

(22) Filed: Apr. 15, 2015

(65) Prior Publication Data

US 2015/0303614 A1 Oct. 22, 2015

(30) Foreign Application Priority Data

Apr. 21, 2014 (JP) ..... 2014-087218
Jul. 10, 2014 (JP) ..... 2014-142044

(51) Int. Cl.
*H01R 13/58* (2006.01)
*H01R 13/56* (2006.01)

(52) U.S. Cl.
CPC ..... *H01R 13/567* (2013.01); *H01R 13/58* (2013.01)

(58) Field of Classification Search
CPC .... H01R 13/56; H01R 13/562; H01R 13/58; H01R 13/5804; H01R 13/5808; H01R 13/5812; H01R 13/5825; H01R 13/585; H01R 13/567; H02G 3/0616
USPC ..... 439/449–473, 521, 893
See application file for complete search history.

(56) References Cited

U.S. PATENT DOCUMENTS 2,662,219 A * 12/1953 Hennessey, Jr. ... H01R 13/5025 439/462
2,877,436 A * 3/1959 Dupee ..... B61G 5/10 439/461
3,792,417 A * 2/1974 Punako ..... H01R 13/5804 439/471
4,265,503 A * 5/1981 Baur ..... H01R 13/627 439/258
7,614,915 B2 * 11/2009 Kamenoue ..... B60R 16/0222 439/623
7,618,280 B2 * 11/2009 Horst ..... H01R 13/5812 439/460
8,257,101 B2 9/2012 Ichio

* cited by examiner

*Primary Examiner* — Neil Abrams
*Assistant Examiner* — Travis Chambers
(74) *Attorney, Agent, or Firm* — Gerald E. Hespos; Michael J. Porco; Matthew T. Hespos

(57) ABSTRACT

A connector (10) includes a housing (30) and terminal-fitted wires (40) are mounted in the housing (30). Each terminal-fitted wire (40) has a terminal (41) with a wire connecting portion (42) connected to a wire (W). The connector (10) also has a retainer (50) with a wire holding portion (55) arranged along the wire connecting portions (42). A grommet (70) surrounds and protects the retainer (50) and the terminals (41). The grommet (70) includes a mounting portion (74) that intersects the wire holding portion (55), and a tie band (80) is mounted around the mounting portion of the grommet (70).

8 Claims, 12 Drawing Sheets

CONNECTOR WITH GROMMET

BACKGROUND

1. Field of the Invention

A technology disclosed by this specification relates to a connector with grommet.

2. Description of the Related Art

U.S. Pat. No. 8,257,101 discloses a vehicle-side connector with a grommet for surrounding and protecting a wire drawn out backward from a housing. The vehicle-side connector has a vehicle-side terminal inserted from behind into a terminal accommodating portion in the housing. A retainer is mounted into the housing from behind and holds the terminal accommodating portion so as not to come out backward. The wire is inserted through the grommet and the grommet is mounted to the housing from behind to protect the wire. However, the wire drawn out backward from the housing may be pulled in a direction oblique to a proper draw-out direction. The grommet is bent together with the wire and an excessive force may be applied to a wire connecting portion connected to the wire in the vehicle-side terminal.

Accordingly, it is an object of the invention to prevent an excessive force to be applied to a wire connecting portion connected to the wire in the vehicle-side terminal.

SUMMARY OF THE INVENTION

The invention relates to a connector with grommet. The connector has at least one terminal-fitted wire that has a terminal with a wire connecting portion connected to a wire. The connector also has a housing in which the terminal-fitted wire is mounted and a retainer with at least one wire holding portion arranged substantially along the wire connecting portion. A grommet at least partly surrounds and protects the retainer and the terminal. An outer surface of the grommet has a mounting portion that is provided circumferentially to intersect the wire holding portion, and at least one tying member is mounted on the grommet by being mounted substantially along the mounting portion in an annular manner.

The rigidity of the grommet is improved by the wire holding portion and the tying member mounted on the grommet. Thus, the wire is less likely to bend in the grommet even if the wire is pulled oblique to a proper draw-out direction. For example, if the wire is pulled away from the wire holding portion, a force pulling the wire is transmitted to the wire holding portion via the tying member and the wire holding portion holds on to suppress bending of the wire. In addition, the wire holding portion is arranged along the wire connecting portion. Thus, the application of an excessive force to the wire connecting portion can be prevented.

Note that a method for directly fixing the wire to the wire holding portion by the tying member is also conceivable to suppress bending of the wire. However, this method, requires the wire to be fixed with the grommet flipped after the grommet is mounted on the wire in advance. Thus, an operation is difficult. In contrast, the invention mounts the tying member to the mounting portion with the grommet mounted on the housing instead of mounting the tying member on the wire holding portion. Thus, the tying member is mounted easily.

The wire connecting portion may extend in a direction perpendicular to a mounting direction of the terminal-fitted wire into the housing. If an attempt is made to bend the wire at a right angle, it is expected that a load is applied to the wire connecting portion due to a bending reaction force of the wire. However, the wire is not be bent in accordance with the invention, and therefore a load is not applied to the wire connecting portion.

The retainer may include a plate-like retainer main body with which the terminal intersects, and the wire holding portion may project in a draw-out direction of the wire from a peripheral edge of the retainer main body. Thus, a load applied to the wire holding portion can be distributed to the retainer main body.

The wire holding portion may be arranged along an inner surface of the grommet. If the inner surface of the grommet and the wire holding portion are not in contact, the wire can bend until the inner surface of the grommet contacts the wire holding portion. However, according to the above configuration, the wire holding portion holds on to suppress bending of the wire from the start of pulling the wire.

The mounting portion may be a recess recessed toward an inner surface from the outer surface of the grommet, and an outer surface of the tying member mounted in the mounting portion may be aligned flush with the outer surface of the grommet or may be formed not to exceed the outer surface of the grommet. Accordingly, other wires and the like are not caught by the tying member since the tying member does not project out from the outer surface of the grommet.

There may be plural wires having different diameters, and thin wires having a relatively small outer diameter may be fixed to the wire holding portion. According to such a configuration, the thin wires can be fixed reliably to the wire holding portion.

The wire holding portion may include a wire fixing portion provided with a through hole through which a tying band is passed, and the thin wires may be fixed to the wire holding portion by passing the tying band through the through hole and winding the thin wires onto the wire fixing portion. Thus, the tying band is not detached from the wire fixing portion and the thin wires can be fixed firmly to the wire fixing portion since the thin wires are wound onto the wire fixing portion by passing the tying band through the through hole.

These and other objects, features and advantages of the invention will become more apparent upon reading the following detailed description of preferred embodiments and accompanying drawings. Even though embodiments are described separately, single features may be combined to additional embodiments.

DETAILED DESCRIPTION

A first embodiment is described with reference to FIGS. 1 to 5. A connector 10 in this embodiment is a connector with grommet including a housing 30 shown in FIG. 1, a retainer 50 shown in FIG. 3 and a grommet 70 shown in FIGS. 4 and 5. The connector 10 is a vehicle-side connector mounted, for example, on a body of an automotive vehicle such as an electric vehicle, a hybrid vehicle or the like and called as an inlet in some cases. Further, although not shown, the connector 10 is, for example, connected to a battery mounted in the automotive vehicle and the battery is charged by connecting a charging connector provided in a charger from the front.

Figure 1:
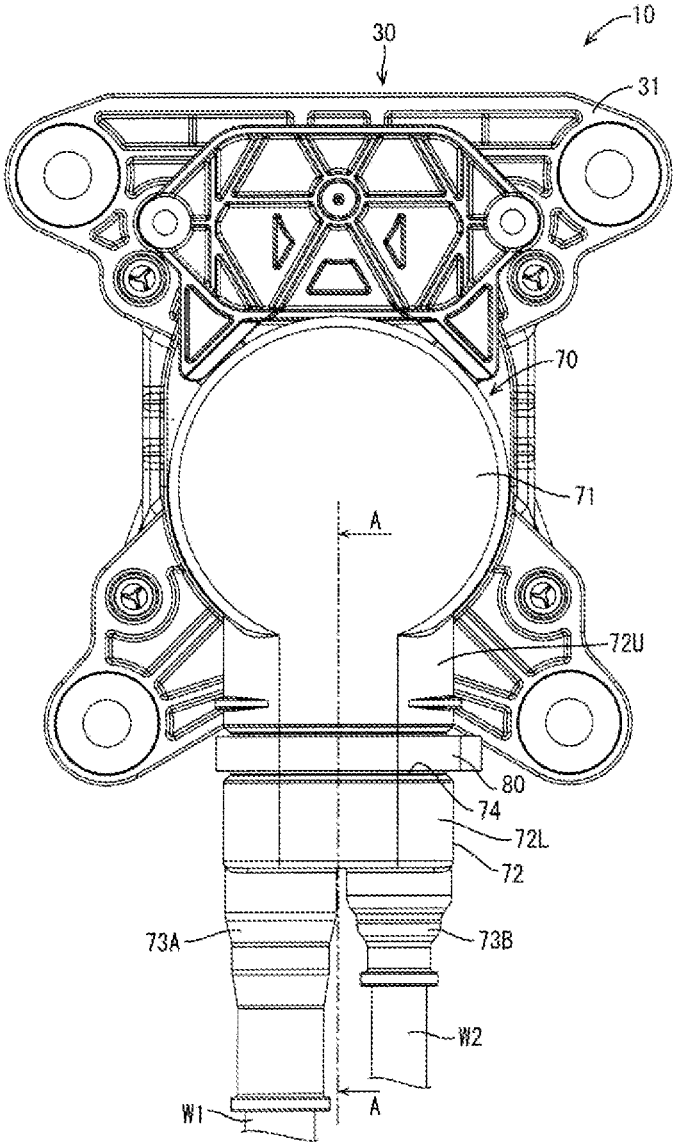
FIG. 1 is a rear view of a connector with grommet in a first embodiment.
Figure 2:
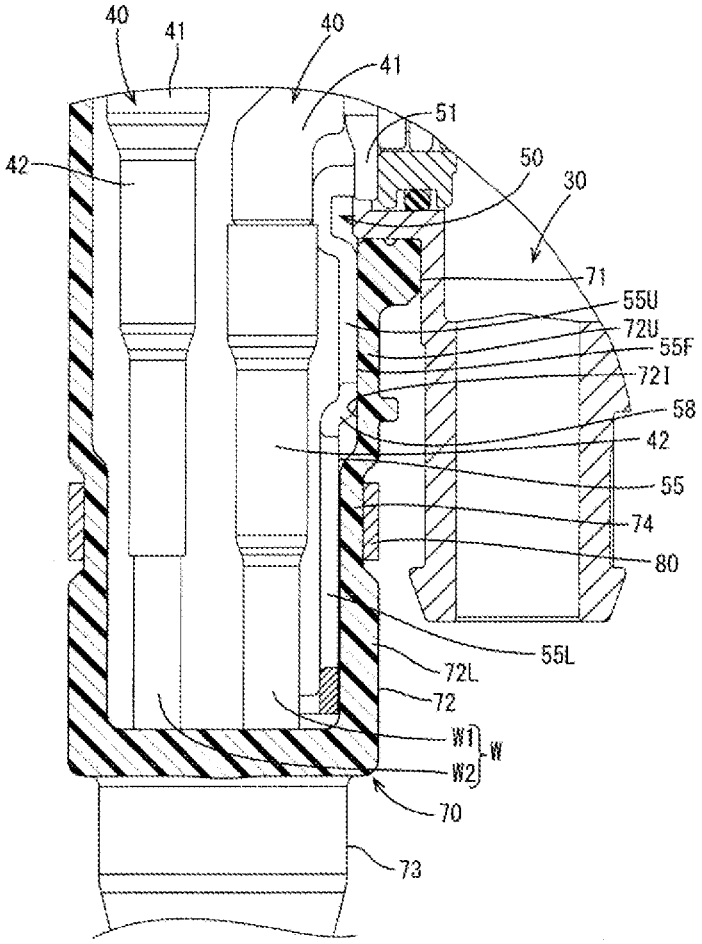
FIG. 2 is a section along A-A of FIG. 1.

As shown in FIG. 1, the housing 30 includes a flange 31 mounted and fixed to the body of the vehicle by bolts. As shown in FIG. 2, terminal-fitted wires 40 are mounted into the housing 30 from behind. The terminal-fitted wire 40 includes an L-shaped terminal 41 and a wire W. The terminals 41 include power supply terminals, a ground terminal and signal terminals and each terminal includes a wire connecting portion 42 to which the wire W is connected. The wire connecting portion 42 is a crimping portion of a closed barrel type to be crimped to a core exposed at an end part of the wire W. Note that the wires W includes high-voltage wires W to be connected to the power supply terminals and low-voltage wires W2 to be connected to the signal terminals, and the low-voltage wires W2 have a smaller outer diameter than the high-voltage wires W1.

Figure 3:
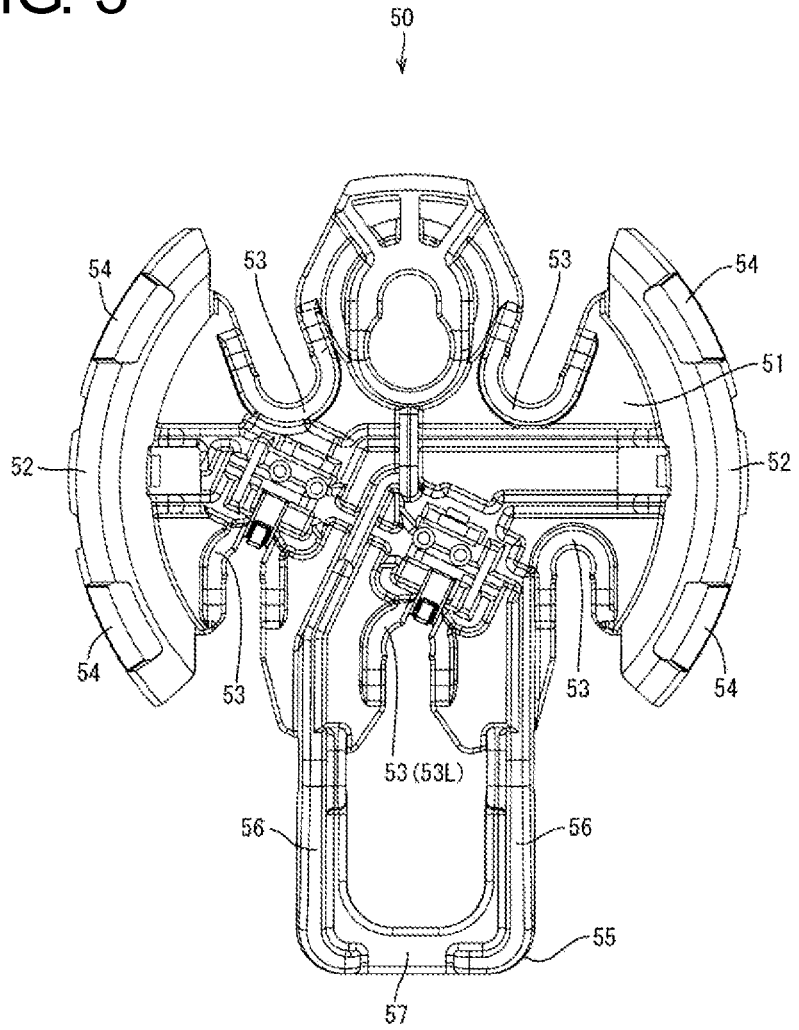
FIG. 3 is a rear view of a retainer.

As shown in FIG. 3, the retainer 50 includes a retainer main body 51 substantially circular in a plan view and two peripheral walls 52 projecting back (toward a front side with respect to the plane of FIG. 3) from a peripheral edge of the retainer main body 51. The retainer main body 51 has terminal fixing portions 53 to which the terminals 41 are to be fixed. The terminal fixing portions 53 are substantially U-shaped openings formed in upper and lower stages and open radially outwardly of the retainer main body 51. Back parts of the terminal fixing portions 53 have a constricted shape. The terminal 41 is fixed to the terminal fixing portion 53 in a posture intersecting the retainer main body 51 by being surrounded over half the circumference or more by this constricted part.

The peripheral wall 52 includes locking portions 54 to be locked to the housing 30. On the other hand, the housing 30 includes locking projections to be locked to the locking portions 54 although not shown. A terminal-fitted retainer is formed by assembling the terminal-fitted wires 40 with the retainer 50 in advance, and the locking portions 54 are locked to the corresponding locking projections to fix the retainer 50 to the housing 30 by assembling the terminal-fitted retainer with the housing 30. Further, the terminals 41 are accommodated into unillustrated cavities of the housing 30 from behind and retained by the terminal fixing portions 53.

A substantially U-shaped wire holding portion 55 extends down from a lower part of the retainer main body 51 and is aligned substantially perpendicular to a mounting direction of the terminal-fitted wires 40 into the housing 30. The wire holding portion 55 includes two leg portions 56 and a coupling 57 that couples the legs 56. The legs 56 are coupled to parts of the peripheral edge of the retainer main body 51 arranged at opposite left and right sides of the terminal fixing portion 53L in the center of the lower stage.

Figure 4:
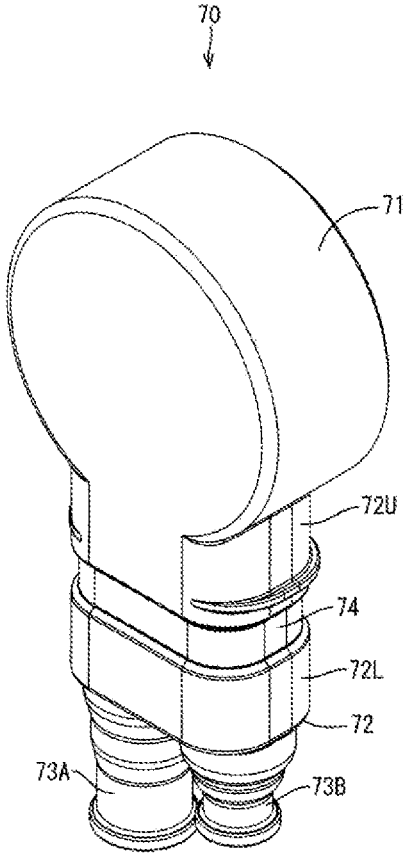
FIG. 4 is a perspective view of a grommet when viewed obliquely from behind.
Figure 5:
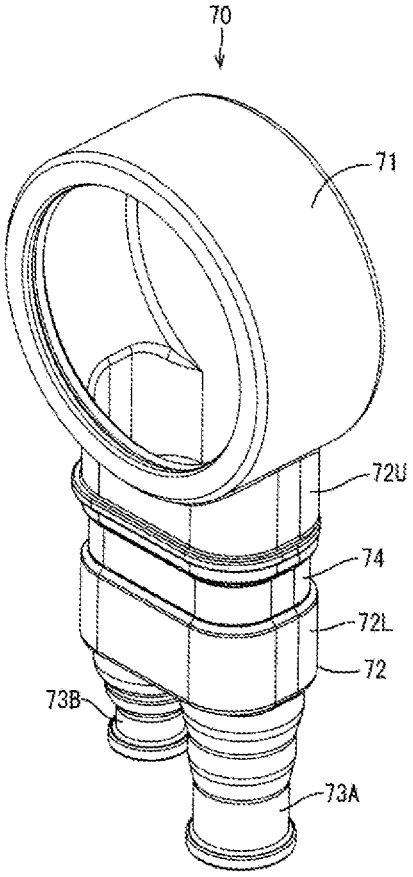
FIG. 5 is a perspective view of the grommet when viewed obliquely from front.

As shown in FIG. 4, the grommet 70 includes a circular lid 71, a tubular portion 72 projecting down from the lid 71 and two pipes 73A, 73B forked at a lower end part of the tubular portion 72. The first pipe 73A is cylindrical and extending down with a substantially constant diameter, and the second pipe 73B has a tapered conical shape with a smaller diameter toward a lower side. Upper ends of the pipes 73A and 73B have substantially the same diameter, whereas the lower end of the second pipe 73B has a smaller diameter than the first pipe 73A. The interiors of the lid 71, the tubular portion 72 and the pipes 73A, 73B communicate with each other. The retainer main body 51 of the retainer 50 can be accommodated into the lid-like portion 71. Further, an inner diameter of the lid-like portion 71 is substantially equal to an outer diameter of the retainer main body 51. Thus, when the grommet 70 is mounted on the housing 30, the retainer main body 51 of the retainer 50 and horizontal parts of the terminals 41 intersecting with the retainer main body 51 are surrounded and protected by the lid 71.

As shown in FIG. 2, the wire connecting portions 42 of the terminals 41, the wires W extending e.g. substantially downwardly from the wire connecting portions 42 and the wire holding portion 55 of the retainer 50 at least partly are accommodated in the tubular portion 72. In this way, the wire connecting portion(s) 42 of the terminal(s) 41, the wire(s) W and the wire holding portion 55 of the retainer 50 at least partly are surrounded and protected by the tubular portion 72. Furthermore, further downward parts of the wires W are surrounded and protected by the pipe-like portions 73A, 73B. Specifically, as shown in FIG. 1, a plurality of high-voltage wires W1 particularly are bundled at one position and inserted into the one (e.g. left) pipe-like portion 73A in FIG. 1 and a plurality of low-voltage wires W2 are bundled at one position and inserted into the other (e.g. right) pipe-like portion 73B in FIG. 1.

An inner surface 72I of the tubular portion 72 is arranged along a front surface 55F of the wire holding portion 55. Thus, the inner surface 72I of the tubular portion 72 and the front surface 55F of the wire holding portion 55 are substantially in contact. On the other hand, a mounting portion 74 in which an annular tie band 80 is to be mounted is provided circumferentially on an outer surface of the tubular portion 72. The mounting portion 74 is recessed toward an inner surface side from the outer surface of the tubular portion 72. Specifically, the tubular portion 72 is constricted at the position of the mounting portion 74. A thickness of the tie band 80 and a depth of the mounting portion 74 are equal. Thus, an outer surface of the tie band 80 mounted in the mounting portion 74 is flush with the outer surface of the tubular portion 72.

A lower part 72L of the tubular portion 72 below the mounting portion 74 is thicker than an upper part 72U. Further, the upper part 72U of the tubular portion 72 and the mounting portion 74 are connected via a step, and the mounting portion 74 has a smaller diameter than the upper part 72U of the tubular portion 72. On the other hand, the wire holding portion 55 includes a step 58 in conformity with the step shape of the tubular portion 72. In this way, an upper part 55U of the wire holding portion 55 above the step 58 is in contact with the upper part 72U of the tubular portion 72 and a lower part 55L of the wire holding portion 55 below the step 58 is in contact with the lower part 72L of the tubular portion 72.

The wire connecting portions 42 of the terminals 41 in the lower stage are at the same height as the mounting portion 74, and those of the terminals 41 in the upper stage are above the mounting portion 74. Further, the tie band 80 mounted in the mounting portion 74 is perpendicular to the wire holding portion 55. Thus, regardless of in which direction the tie band 80 is moved such as due to the swinging of the wires W, the tie band 80 certainly interferes with the wire holding portion 55 and the swinging of the wires W is prevented.

If the wires W are pulled back (leftward in FIG. 2), the pipes 73A, 73B are bent forwardly by the wires W, but the lower part 72L of the tubular portion 72 holds on. Thus, the bending of the wires W in the tubular portion 72 is suppressed to a certain extent. However, if the wires W are pulled back with a strong force, the lower part 72L of the tubular portion 72 is pulled back by being dragged by the pipes 73A, 73B and the tie band 80 is likely to be pulled back. Here, a backward movement of the tie band 80 is suppressed by the wire holding portion 55, the upper part 72U of the tubular portion 72 is not pulled backwardly and the bending of the wires W accommodated in the tubular portion 72 is suppressed. Thus, an excessive force is not applied to the wire connecting portions 42 connected to the wires W.

The wire holding portion 55 prevents the grommet 70 from being detached from the housing 30 when the wires W are pulled. Further, the lid 71 can be flipped while the tubular portion 72 is hooked to the wire holding portion 55 in mounting the grommet 70 on the housing 30, the grommet 70 is mounted easily on the housing 30.

The wire holding portion 55 and the tie band 80 mounted on the grommet 70 improve the rigidity of the grommet 70. Thus, bending of the wires in the grommet 70 is suppressed even if the wires W are pulled oblique to a proper draw-out direction. For example, a force to pull the wires W away from the wire holding portion 55 is transmitted to the wire holding portion 55 via the tie band 80 and the wire holding portion 55 holds on to suppress bending of the wires W. In addition, the wire holding portion 55 is arranged along the wire connecting portions 42, and prevents application of excessive force to the wire connecting portions 42.

A method for directly fixing the wires W to the wire holding portion 55 by the tie band 80 is also conceivable to suppress bending of the wires W. However, in this method, the wires W need to be fixed with the grommet 70 flipped after the grommet 70 is mounted on the wires W in advance. Thus, an operation is difficult. However, in the above configuration, the tie band 80 is mounted into the mounting portion 74 with the grommet 70 mounted on the housing 30 instead of mounting the tie band 80 on the wire holding portion 55. Thus, the tie band 80 is mounted easily.

The wire connecting portions 42 may extend perpendicular to the mounting direction of the terminal-fitted wires 40 into the housing 30.

If an attempt is made to bend the wires W e.g. at a right angle, it is expected that a load is applied to the wire connecting portions 42 due to a bending reaction force of the wires W. In that respect, according to the above configuration, a load is not applied to the wire connecting portions 42 due to the bending reaction force of the wires W since the wires W need not be bent.

The retainer 50 may have the plate-like retainer main body 51 that intersects the terminals 41 and the wire holding portion 55 may extend in the draw-out direction of the wires W from the periphery of the retainer main body 51. Thus, a load applied to the wire holding portion 55 can be distributed to the retainer main body 51.

The wire holding portion 55 may be arranged along the inner surface of the grommet 70.

If the inner surface of the grommet 70 and the wire holding portion 55 are not in contact, the bending of the wires W is permitted until the inner surface of the grommet 70 contacts the wire holding portion 55. However, according to the above configuration, the wire holding portion 55 holds on to suppress the bending of the wires W from the start of pulling the wires W.

The mounting portion 74 may be a recess recessed toward the inner surface side from the outer surface of the grommet 70 and the outer surface of the tie band 80 mounted in the mounting portion 74 may be substantially flush with or inward of the outer surface of the grommet 70. Accordingly, other wires and the like are not caught by the tie band 80.

A second embodiment is described with reference to FIGS. 6 to 12. A connector 110 of the second embodiment has a retainer that differs from the first embodiment. However, the remainder of the configuration is substantially the same as the first embodiment. Thus, elements of the second embodiment that are the same as the first embodiment are not described again and merely are identified by the same reference numbers.

Figure 6:
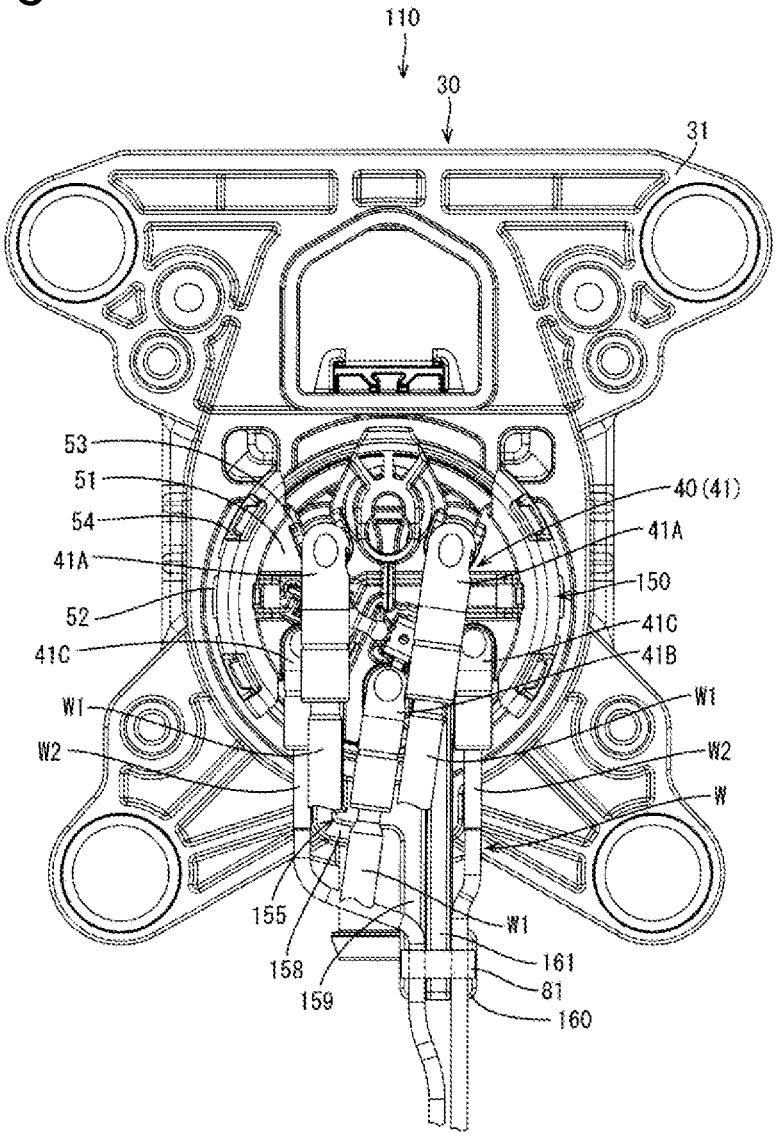
FIG. 6 is a rear view of a retainer of a second embodiment in use.

As shown in FIG. 6, wires W include at least two high-voltage wires W1 and two low-voltage wires W2. On the other hand, terminals 41 include power supply terminals 41A, a ground terminal 41B and signal terminals 41C. Left and right power supply terminals 41A are arranged in an upper stage, one ground terminal 41B is arranged in a lower stage and left and right signal terminals 41C are arranged in a middle stage.

Figure 7:
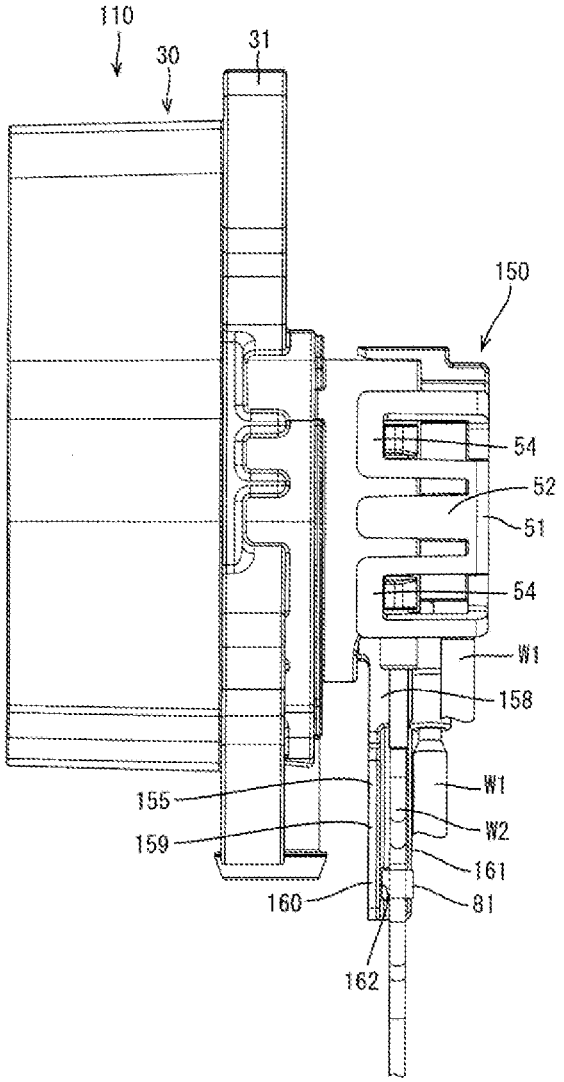
FIG. 7 is a side view showing the used state of the retainer.

Three high-voltage wires W1 are provided as shown and the power supply terminals 41A and the ground terminal 41B are connected respectively to the high-voltage wires W1. Further, two low-voltage wires W2 are provided as shown and signal terminals 41C are connected respectively to the low-voltage wires W2. As shown in FIG. 7, the low-voltage wires W2 are arranged on a foremost side near a flange 31, and the high-voltage wire W1 connected to the ground terminal 41B and the high-voltage wires W1 connected to the power supply terminals 41 are arranged side by side in this order behind the low-voltage wires W2.

The connector 110 has a retainer 150 with a wire holding portion 155 that differs from the wire holding portion 55 of the first embodiment. The wire holding portion 155 extends down from a lower part of a retainer main body 51 and is perpendicular to a mounting direction of terminal-fitted wires 40 into a housing 30. The wire holding portion 155 includes a U-shaped portion 158 that projects down from the lower part of the retainer main body 51 and a wire fixing portion 159 that extends down from the U-shaped portion 158. The U-shaped portion 158 includes two legs 156 and a coupling 157 that couples the legs 156. The legs 156 are coupled to parts of a peripheral edge of the retainer main body 51 at opposite left and right sides of a terminal fixing portion 53L in the center of the lower stage.

The wire fixing portion 159 is about half as wide as the coupling 157, and extends down from a right half of the coupling 157. The wire fixing portion 159 includes a winding portion 160 that is on a lower part of the wire fixing portion 159 and is wider than the wire fixing portion 159. Further, a straight reinforcing rib 161 extends down from the leg 156 located above the wire fixing portion 159. The reinforcing rib 161 is at a right end position of the wire fixing portion 159 in a lateral direction while being located in a center of the winding portion 160.

Figure 10:
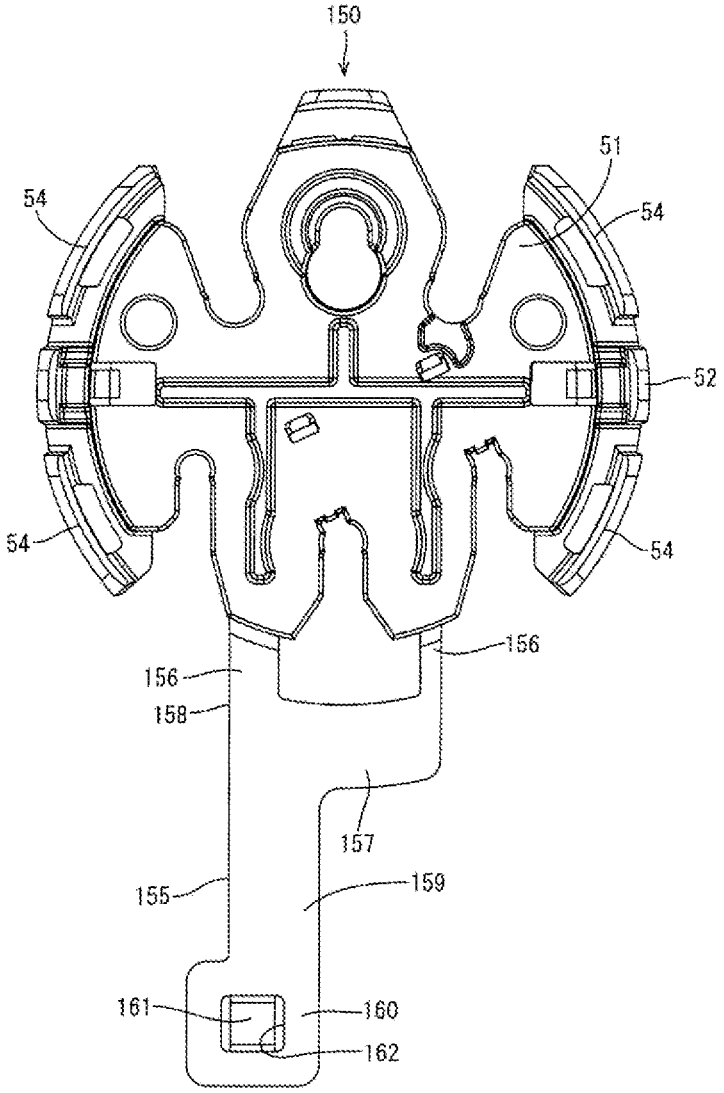
FIG. 10 is a front view of the retainer.
Figure 11:
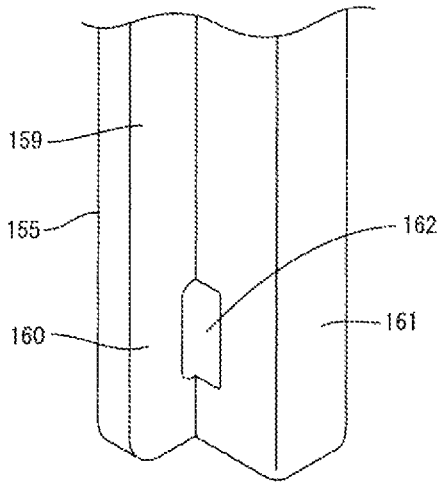
FIG. 11 is an enlarged perspective view of a part of a wire fixing portion.
Figure 12:
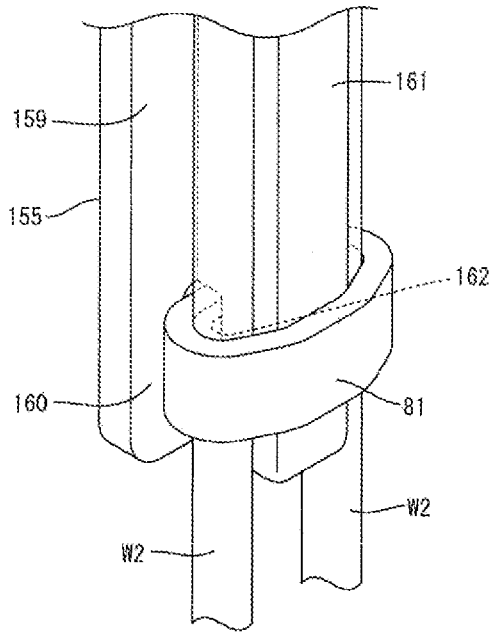
FIG. 12 is an enlarged perspective view showing a state where low-voltage wires are fixed to the wire fixing portion by the tying band.

As shown in FIG. 11, the winding portion 160 has a through hole 162 through which a tying band 81 is passed. The through hole 162 is on a part of the reinforcing rib 161 coupled to the winding portion 160 and is arranged on a mounting side (front side with respect to the plane of FIG. 10) of the retainer 150 into the housing 30, as shown in FIG. 10. As shown in FIG. 12, the two low-voltage wires W2 are arranged on opposite left and right sides of the reinforcing rib 161 along the winding portion 160 and the tying band 81 is passed through the through hole 162 and wound to fix the low-voltage wires W2 to the winding portion 160 and the reinforcing rib 161.

Figure 8:
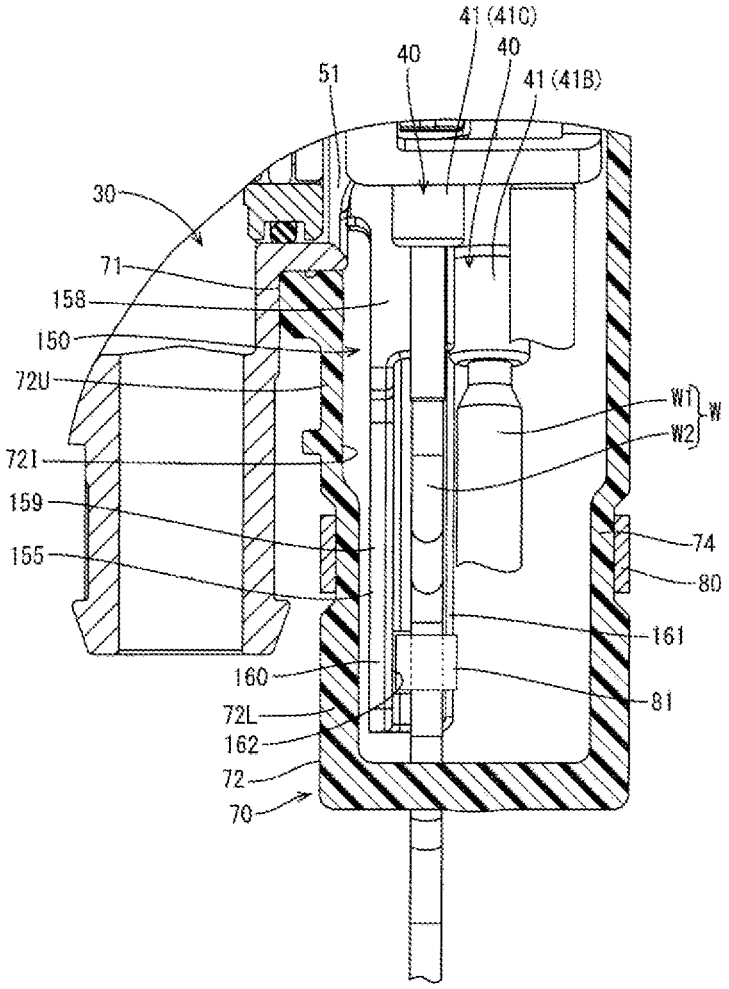
FIG. 8 is a section, corresponding to FIG. 2, showing a state where a tying band is passed through a through hole.
Figure 9:
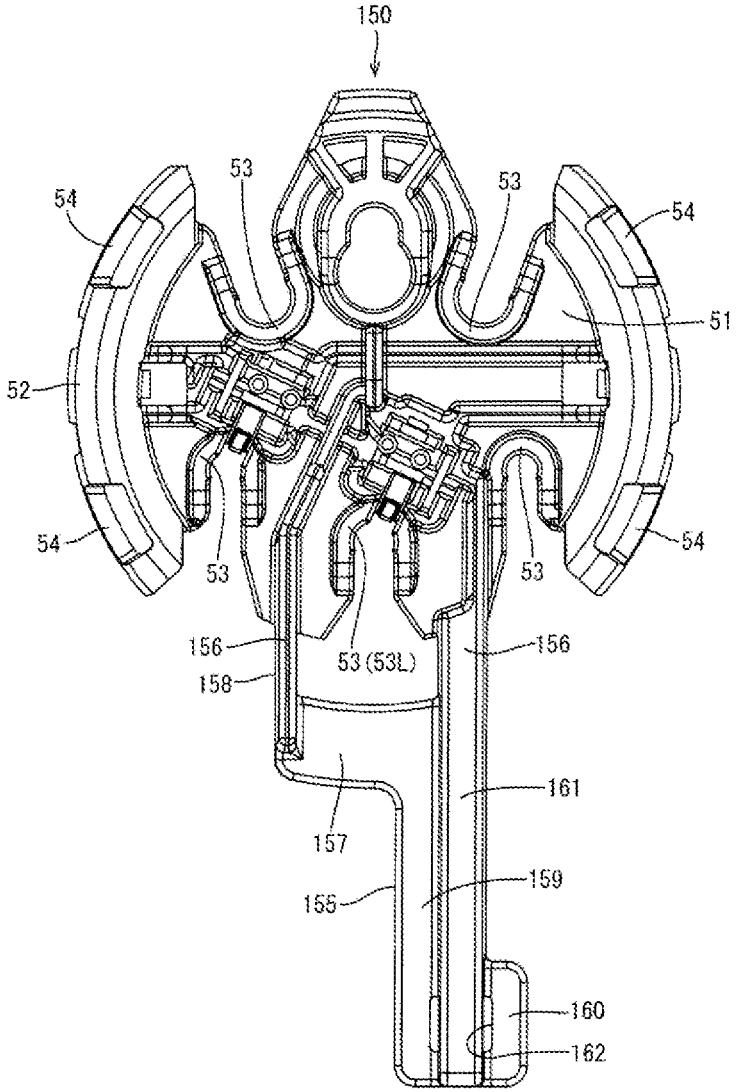
FIG. 9 is a rear view of the retainer.

As shown in FIG. 7, the low-voltage wires W2 are arranged along the wire fixing portion 159 and the winding portion 160 and at a position distant from the back surface of a grommet 70. Thus, if the low-voltage wires W2 are not held onto the wire holding portion 155 as in the first embodiment, the low-voltage wires W2 are pulled back and bent at a considerable angle until the pulling of the low-voltage wires W2 is suppressed by a tie band 80 and a pulling force is applied to the wire connecting portions 42 of the signal terminals 41C. However, the low-voltage wires W2 are fixed directly to the winding portion 160. Thus, the pulling force is not applied to a side above the winding portion 160, i.e. not applied to the wire connecting portions 42 of the signal terminals 41C. Further, as shown in FIG. 8, the winding portion 160 is below the tie band 80. Thus, pulling of the low-voltage wires W2 is suppressed by the tying band 81 before being suppressed by the tie band 80 and a pulling force is not applied to the wire connecting portions 42 of the signal terminals 41C. Note that a case where the high-voltage wires W1 are pulled back is not described since it is the same as in the first embodiment.

As described above, the wires W have different outer diameters and the thin wires are fixed to the wire holding portion 155. Thus, the thin wires are fixed reliably to the wire holding portion 155.

Further, the wire holding portion 155 may include the wire fixing portion 159 provided with the through hole 162 through which the tying band 81 is passed, and the thin wires may be fixed to the wire holding portion 155 by passing the tying band 81 through the through hole 162 and winding the thin wires onto the wire fixing portion 159. Thus, the tying band 81 is not detached from the wire fixing portion 159 and the thin wires are fixed firmly to the wire fixing portion 159 since the tying band 81 is passed through the through hole 162 and the thin wires are wound onto the wire fixing portion 159.

The technology disclosed in this specification is not limited to the above described embodiment. For example, the following modes are also included.

The tie band 80 is flush with the outer surface of the grommet 70 in the above embodiments, but another mode may be adopted if the outer surface of the tie band 80 does not exceed the outer surface of the grommet 70.

The terminal 41 need not be L-shaped.

The terminals 41 intersect the retainer main body 51 in the above embodiments, but a plate-like retainer main body may retain the terminals by being arranged behind the terminals and locking rear ends of the terminals from behind.

The wire holding portion 55 contacts the inner surface of the grommet 70 in the first embodiment, but a tiny clearance may be present between the wire holding portion 155 and the inner surface of the grommet 70 as in the second embodiment.

Although the mounting portion 74 is a recess in the tubular portion 72 in the above embodiments, but may be flush with the outer surface of the tubular portion.

The low-voltage wires W2 are not fixed directly to the wire holding portion 55 in the first embodiment, but they may be fixed directly to the wire holding portion 55 using the tying band 81 or the like also in the first embodiment.

The low-voltage wires W2 are fixed to the wire fixing portion 159 by winding the tying band 81 onto the winding portion 160 in the second embodiment. However, a lid coupled to a lateral side of the wire fixing portion 159 via a hinge may be rotated toward the wire fixing portion 159 and locked to fix the low-voltage wires W2.

Although the low-voltage wires W2 are illustrated as the thin wires in the second embodiment, the thin wires have only to have a relatively small diameter and are not determined based on voltage.

REFERENCE SIGNS

10, 110 . . . connector (connector with grommet)
30 . . . housing
40 . . . terminal-fitted wire
41 . . . terminal
42 . . . wire connecting portion
50, 150 . . . retainer
51 . . . retainer main body
55 . . . wire holding portion
70 . . . grommet
72I . . . inner surface (of tubular portion)
74 . . . mounting portion
80 . . . tie band (tying member)
81 . . . tying band
155 . . . wire holding portion
159 . . . wire fixing portion
160 . . . winding portion
162 . . . through hole
W . . . wire
W2 . . . low-voltage wire (thin wire)

What is claimed is:

1. A connector, comprising:

a housing;

at least one terminal-fitted wire mounted in the housing and having a terminal with a wire connecting portion connected to a wire;

a retainer with at least one wire holding portion arranged substantially along the wire connecting portion;

a grommet least partly surrounding and protecting the retainer and the terminal, an outer surface of the grommet having a mounting portion intersecting the wire holding portion, the mounting portion defining a recess recessed in from the outer surface of the grommet; and at least one tying member mounted around the mounting portion of the grommet.

2. The connector of claim 1, wherein the wire connecting portion extends at an angle to a mounting direction of the terminal-fitted wire into the housing.

3. The connector of claim 1, wherein the retainer includes a retainer main body with which the terminal intersects, and the wire holding portion projects in a draw-out direction of the wire from a peripheral edge of the retainer main body.

4. The connector of claim 1, wherein the wire holding portion is arranged substantially along an inner surface of the grommet.

5. The connector of claim 1, wherein an outer surface of the tying member mounted in the mounting portion is substantially flush with or inward of the outer surface of the grommet.

6. The connector of claim 1, wherein the wires have different diameters, and include at least one thin wire fixed to the wire holding portion.

7. A connector, comprising:

a housing, terminal-fitted wires mounted in the housing, each of the terminal-fitted wires having a terminal with a wire connecting portion connected to a wire, the wires having different diameters, and include at least one thin wire;

a retainer with at least one wire holding portion arranged substantially along the wire connecting portion, the thin wire being fixed to the wire holding portion, the wire holding portion including a wire fixing portion with a through hole;

a grommet least partly surrounding and protecting the retainer and the terminal, an outer surface of the grommet having a mounting portion intersecting the wire holding portion; and at least one tying member mounted around the mounting portion of the grommet, the tying member including a tying band passed through the through hole in the wire fixing portion.

8. The connector of claim 7, wherein the thin wire is fixed to the wire holding portion by passing the tying band through the through hole and winding the thin wire onto the wire fixing portion.

* * * * *